US006196805B1

(12) United States Patent
Reilley

(10) Patent No.: US 6,196,805 B1
(45) Date of Patent: Mar. 6, 2001

(54) METHOD AND APPARATUS FOR OSCILLATINGLY ELEVATING FLUID

(76) Inventor: Peter V. Reilley, 20 King Arthur Dr., Londonderry, NH (US) 03053

( * ) Notice: Subject to any disclaimer, the term of this patent is extended or adjusted under 35 U.S.C. 154(b) by 0 days.

(21) Appl. No.: 09/437,082

(22) Filed: Nov. 9, 1999

(51) Int. Cl.[7] ..... F04D 33/00

(52) U.S. Cl. ..... 417/53; 137/38; 137/571; 137/581; 417/572; 417/330

(58) Field of Search ..... 137/38, 44, 45, 137/571, 581; 417/53, 572

(56) References Cited

U.S. PATENT DOCUMENTS

| | | | | |
|---|---|---|---|---|
| 468,691 | * | 2/1892 | Proctor | 137/38 X |
| 576,006 | * | 1/1897 | Tilden | 137/581 X |
| 691,270 | * | 1/1902 | Jones | 137/581 X |
| 1,496,695 | * | 6/1924 | Wetzel | 137/38 |
| 1,933,753 | * | 11/1933 | Parsons | 137/38 X |
| 4,241,755 | * | 12/1980 | Snyder | 137/581 X |
| 4,664,144 | * | 5/1987 | Lemmon | 137/571 |

* cited by examiner

*Primary Examiner*—John Rivell
(74) *Attorney, Agent, or Firm*—George W. Dishong

(57) ABSTRACT

A fluid ladder or a fluid lifter and a method for lifting a liquid or a flowable or fluid-like material such as grains, sand, soil, and the like from one level to a higher level preferably through oscillation. The fluid ladder is capable of lifting fluids without the use of conventionally known pump devices and without the need for energy sources such as electrical energy, combustion energy and the like. The apparatus may be operable using energy sources such as that provided by muscles e.g., the muscle use of a human being or animal or the energy provided by oscillatory wave motion of a body of fluid. The fluid ladder lifts fluid through a series of, or a plurality of, reservoirs. Each reservoir of the series of reservoirs is subsequently positioned at increasing heights from the body of fluid being lifted and each of the reservoirs is connected sequentially or serially through a series of channels the reservoirs connected such that fluid flows from one reservoir to the adjacent and more elevated reservoir, when the ladder is positioned for use to lift fluid and appropriately oscillated or rocked. The reservoirs, or at least a portion of the reservoir volumes, are raised and lowered by the rocking motion and consequently fluid flows sequentially to higher reservoirs. The achieved elevation change of the fluid for each cycle of oscillation or rocking cycle of the apparatus is a function of the vertical spacing between subsequent reservoirs. The horizontal spacing between subsequent reservoirs, in combination with the vertical spacing and the consequential angle of the connecting channel which connect adjacent reservoirs, impacts on the amplitude of the oscillation needed to cause fluid elevation with each cycle of oscillation. The controllable angle of inclination of the ladder device relative to the vertical from the surface of the fluid being elevated may be used to control the volume of the packets of fluid being sequentially elevated and exited from the exit port of the device.

16 Claims, 6 Drawing Sheets

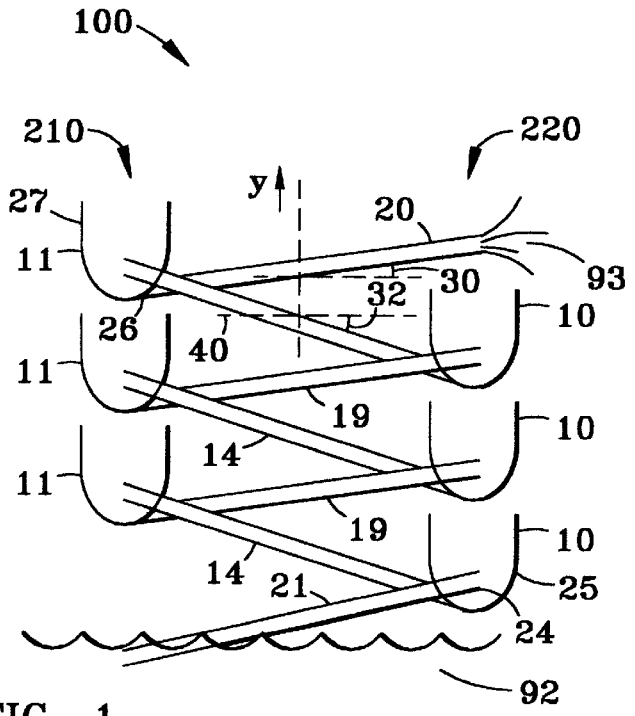
FIG. 1
FIG. 2A
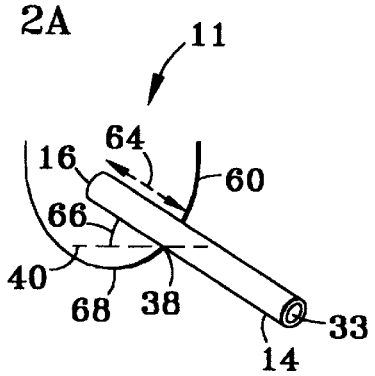
FIG. 2B
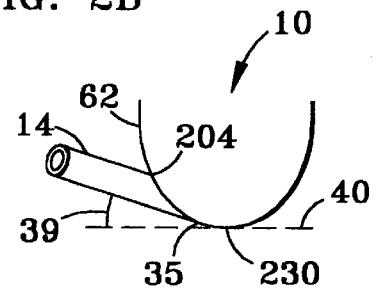
FIG. 2C
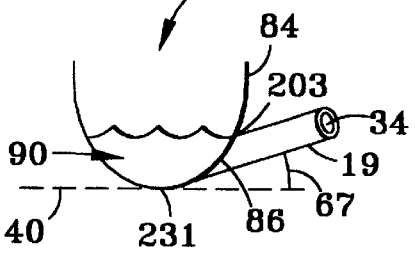
FIG. 2D
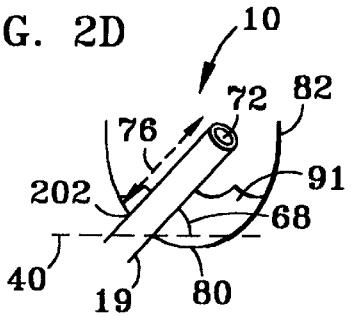

CURVED FLEXABLE TUBE

TUBES CONNECTED IN SERIES TO
ACT AS LADDER

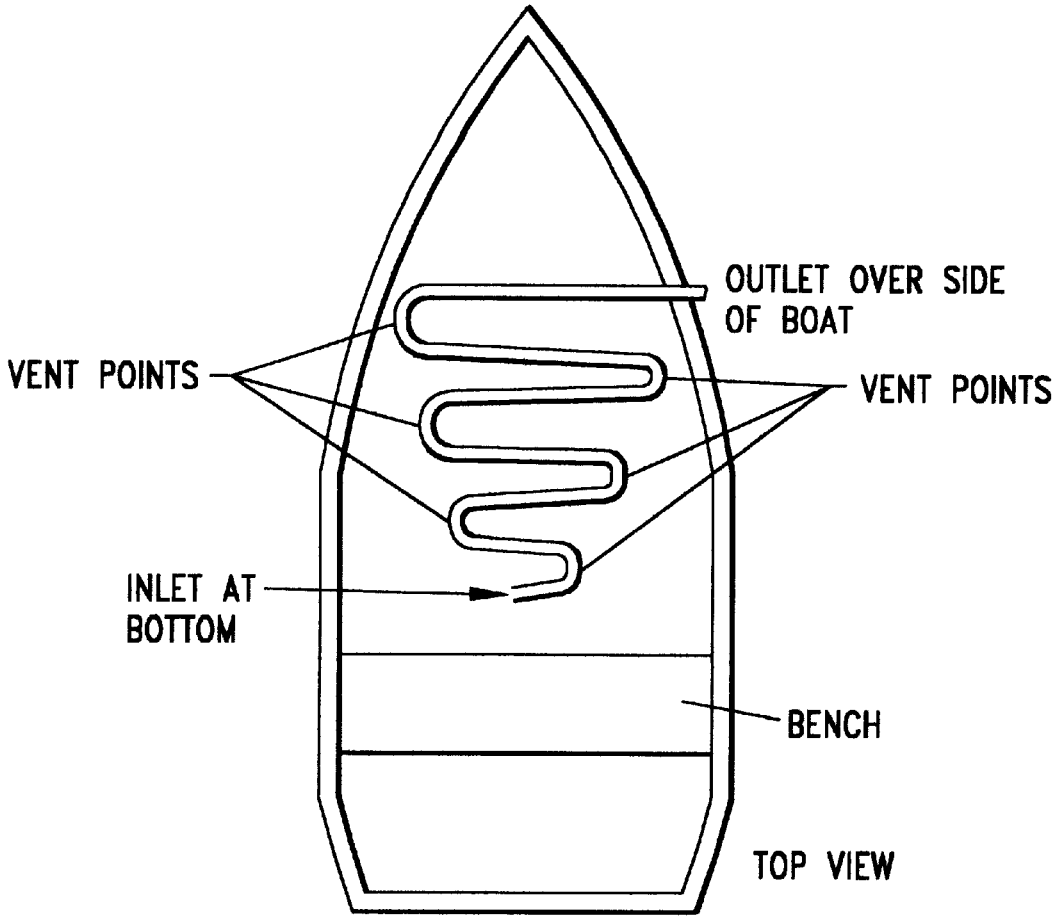
FIG. 9A
FIG. 9B
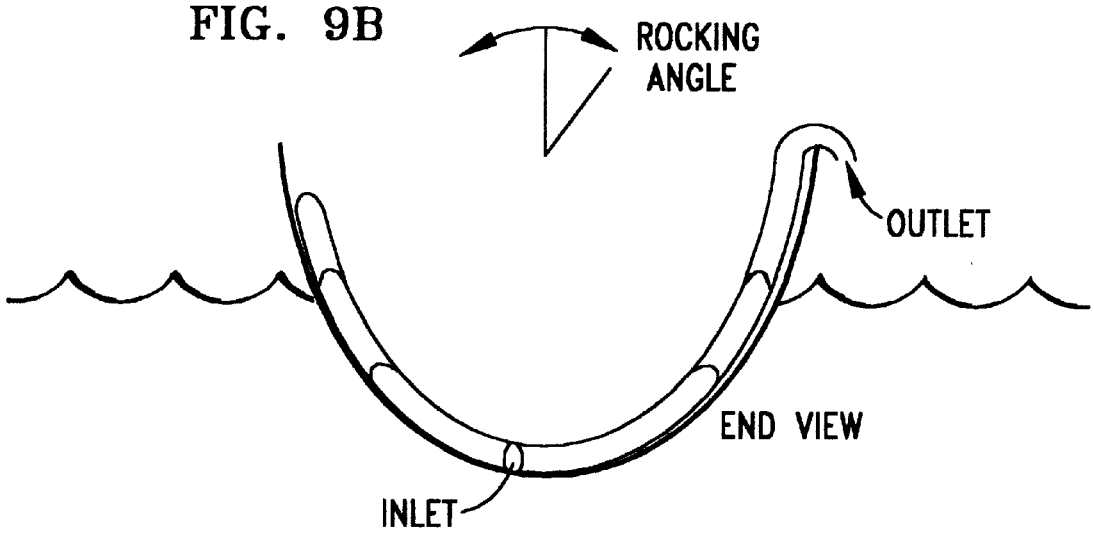

METHOD AND APPARATUS FOR OSCILLATINGLY ELEVATING FLUID

CROSS-REFERENCE TO RELATED APPLICATIONS

The invention disclosed herein is based upon the invention disclosed in Disclosure Document No. 444802 filed Oct. 26, 1998.

STATEMENT REGARDING FEDERALLY SPONSORED RESEARCH OR DEVELOPMENT

Not Applicable.

BACKGROUND OF THE INVENTION

1. Field of the Invention

The present invention is directed to a method and an apparatus for lifting fluid from one level to another level preferably through oscillation or rocking of the apparatus relative to a surface of fluid. Particularly, the apparatus is capable of lifting fluids without the use of conventionally known pump devices and without the need for energy sources such as electrical energy, combustion energy and the like. The apparatus may be operable using energy sources such as that provided by muscles e.g., the muscle use of a human being or animal or the energy provided by oscillatory wave motion of a body of fluid. Most particularly, the apparatus lifts fluid through a series of or a plurality of reservoirs—reservoirs as used herein being a volume situated and configured such that the direction of fluid flow into the reservoir is different from the direction of fluid flow out of the reservoir. Each reservoir of the series of reservoirs—there being at least two (2) reservoirs—is subsequently positioned at increasing heights from the body of fluid being lifted and each of the reservoirs is connected each to the other through a series of channels. Channels or connecting channels, as used herein, define the fluid-flow path between subsequent reservoirs and may or may not be discretely definable connecting channels such as tubes. The achieved elevation change of the fluid for each cycle of oscillation or rocking cycle of the apparatus is a function of the vertical spacing between subsequent reservoirs. The horizontal spacing between subsequent reservoirs in combination with the vertical spacing and the consequential angle of inclination of the connecting channel, which connect adjacent reservoirs, impacts on the amplitude of the oscillation needed to cause fluid elevation with each cycle of oscillation.

2. Description of Related Art

The need to move fluid against gravity is at least 2,000 years old, and arose from the need to irrigate fields. Archimedes provided one solution to the problem with the simple, but powerful, screw or scroll to draw water from a source to a higher destination. This solution required human or animal power. Other fluid-lifting problems have arisen since Archimedes time, and other solutions have been developed. One such lifting problem is boat bailing, in which water must be moved from the bottom of the boat up over the edge of the boat and then into the water in which the boat is floating. Another such problem is fish migration over dammed water, in which water is forced to different heights through damming, and some means is necessary to allow fish to travel from one level to another. A third such problem is the lifting of non-liquid but flowable materials such as sand, grains, powders, gravel and the like, i.e., materials that flow in a fluid-like manner.

Current bailing methods for small boats include manual pumps, electric pumps, buckets, and boat-motion driven diaphragm pumps. Each has its disadvantages. Manual pumps and buckets require physical labor and can only be used when someone is present. Electric bilge pumps require a power source. If the boat's battery is used, there is risk of completely discharging the battery and disabling the engine's starter. Diaphragm pumps are complicated mechanical devices with multiple moving parts subject to malfunction.

A fish ladder is a series of pools that step-wise rise from the dam's discharge area to the height of the lake behind the dam. Current fish ladder technology involves water at the higher level cascading down the series of pools that allows migrating fish to swim upstream. Fish climb the ladder by jumping from one pool to the next. This method requires the ladder size to vary with the depth of the water behind the dam.

U.S. Pat. No. 3,644,062 discloses a bilge pump for a boat or vessel of any type that responds to any movement of the boat, such as pitching or rolling. In this invention, the movement of the boat rotates a shaft which in turn operates diaphragm-type pumps that pump bilge water through intake pipes and valves and discharge the water through outlet valves and pipes. This device is constructed of moving mechanical parts that are subject to failure through exposure to weather and water.

U.S. Pat. No. 4,075,965 discloses a dual system of inflatable "lifters" that raise the level of the boat above its normal float level when they are inflated. They allow rain water to drain out of the boat because the drain hole is above the level of the water when the lifters are inflated. Although this method of bailing can happen automatically, it is also subject to failure if, for example, the floats develop leaks.

U.S. Pat. No. 5,044,295 discloses an apparatus for removing water out of a boat, which comprises a swingable member which is swingable according to a rolling and/or pitching motion of the boat, and a water discharging pump means which is operated by the swinging motion of said swingable member. In the apparatus, the water discharging pump means comprises an inlet valve and an outlet valve which are led respectively to a pool of bilge water and outside of the boat through a suction pipe and discharge pump, respectively. This device derives its energy from the underlying water movement, but again, it is composed of several moving mechanical parts subject to failure under continued exposure.

U.S. Pat. No. 5,346,369 discloses a pump actuated by a reciprocal oscillating motion, comprising a cylinder connecting bellows on each end that contain pumping chambers with one way intake and output ports. There is a piston in each chamber that compresses and allows to release the bellows, and thus actuates the pump. This is another example of a complicated mechanical device that might tend to fail under exposure.

Clearly the instant invention provides many advantages over current fluid pumping systems especially where access to power sources is limited or expensive and where it is desired that the movement of fluid be in incremental packets. Some of the advantages of the present invention are:

- Simple and light-weight;
- Does not require manual intervention;
- Does not require power sources such as electrical or combustion engine power in order to function;
- Has substantially no moving parts; and
- It is robust under environmental exposure.

BRIEF SUMMARY OF THE INVENTION

Most fundamentally, the invention can be viewed as a method and an apparatus for changing the level of a captured incremental packet of fluid as a consequence of a rocking or oscillatory motion relative to, for example, the surface of a fluid from which the captured packet has been taken. There are many forms of apparatus which will, consequently of rocking, cause fluid to be captured and sequential with the rocking or oscillation of the apparatus, cause the captured fluid packet to directionally flow through "connecting channels" from one "reservoir" to another subsequent elevated reservoir. An example of an apparatus is a conical pipe or tube which is curved upward at both the larger and smaller diameter ends. If the conical pipe is partially filled with fluid (i.e., a captured packet of fluid), when the conical pipe is rocked so as to lower the larger diameter end, the fluid will extend, from fluid surface location near the larger diameter end to the fluid surface location toward the smaller diameter end and within the pipe, a determinable distance. When the pipe is rocked so as to lower the smaller diameter end, the distance between the two fluid surface locations is increased. I.e., since the volume of packet of fluid has not changed but the average cross sectional area has decreased, the length of the packet of fluid must increase. Consequently the packet of fluid picked up or captured during the oscillation phase where the larger diameter end is lowered is elevated and may pour out of the opening at the smaller diameter end. If there is another conical pipe with the large diameter end located so as to capture the fluid coming from the first conical pipe, the captured fluid will be further elevated and will pour out of the smaller diameter end of the second conical pipe. It is clear that this process will result in the periodic discharge of fluid, the period being related to the frequency of the rocking or oscillatory motion of the apparatus.

The fluid ladder of the present invention is capable of lifting fluids, in the form of a liquid, or a fluid-like non-liquid but flowable materials such as sand, grains, powders, gravel and the like, i.e., materials that flow in a fluid-like manner without the use of conventionally known pump devices and without the need for energy sources such as electrical energy, combustion energy and the like. The apparatus may be operable using energy sources such as that provided by muscles e.g., the muscle use of a human being or animal or the energy provided by oscillatory wave motion of a body of fluid. The fluid ladder lifts fluid through a series of, or a plurality of, reservoirs. Each reservoir of the series of reservoirs is subsequently positioned at increasing heights from the body of fluid being lifted. Each of the reservoirs is connected sequentially or serially through a series of channels. The reservoirs are connected in such a manner that fluid flows from one reservoir to the adjacent and more elevated reservoir, when the ladder is positioned for use to lift fluid and appropriately oscillated or rocked. The reservoirs, or at least a portion of the reservoir volumes, are raised and lowered by the rocking motion and consequently fluid flows sequentially to higher reservoirs. The achieved elevation change of the fluid for each cycle of oscillation or rocking cycle of the apparatus is a function of the vertical spacing between subsequent reservoirs. The horizontal spacing between subsequent reservoirs, in combination with the vertical spacing and the consequential angle of inclination of the connecting channel which connect adjacent reservoirs, impacts on the amplitude of the oscillation needed to cause fluid elevation with each cycle of oscillation.

Fluid is lifted to higher levels by the rocking motion of the apparatus such as the ladder-type apparatus, which apparatus will be frequently referred to simply as a ladder or the ladder. In the case of a fluid-like solid, simultaneous vibrating and rocking the ladder may provide an increase in flow volume, i.e., cause better flow. Fluid flows upwardly from the body of fluid from the lowest to the highest of the reservoirs through connecting channels connecting adjacent or subsequently more elevated reservoirs. It should be understood that the reservoirs are considered as subsequently elevated when the apparatus is positioned for use in the elevation of fluid. Fluid is prevented from flowing down the ladder by the design and geometry of the structure of the connection between the channels and the reservoirs.

The present invention may be used to: bail water from boats, function as a fish ladder; lift both liquid and liquid-like flowable substances and which will deliver at the elevated output end of the lifter, a consistent amount of fluid or packet of fluid (the size of the volume of the packet of fluid being determinable and a function of the geometry of the reservoirs) each cycle of oscillation or the apparatus, i.e., incrementally deliver, once each cycle, a predetermined amount of fluid for a predetermined number of times based upon the number of cycles of oscillation.

Fundamental objects of the invention is to provide a simple fluid lifter that: (1) does not rely on moving parts; (2) that can withstand outdoor environmental conditions without frequent maintenance and failure; (3) that can lift both liquid and liquid-like flowable substances; and (4) which will deliver at the elevated output end of the lifter, a consistent amount of fluid or packet of fluid (the size of the volume of the packet of fluid being determinable and a function of the geometry of the reservoirs) each cycle of oscillation or the apparatus. I.e., the fluid lifter of the present invention will incrementally deliver, once each cycle, a predetermined amount of fluid for a predetermined number of times based upon the number of cycles of oscillation.

A basic aspect of the invention is to provide an apparatus for changing the level of a captured packet of fluid. The packet of fluid has a predetermined volume and the captured packet of fluid is as a consequence of a rocking motion relative to the surface of a body of fluid from which the captured packet of fluid is to be taken. The fluid level changing apparatus comprises at least one member and where there is one member, this one member is called the first member. The first member comprises, an input aperture positionable at the surface of the fluid for capturing the packet of fluid, an input reservoir portion into which the captured packet of fluid enters, a connecting channel portion contiguous and in flow communication with the input reservoir portion, an output reservoir portion in unidirectional flow communication with the connecting channel portion, wherein the unidirectional flow is from the input reservoir portion to the output reservoir portion. Further there is an output aperture from which the packet of fluid exits at a level above the level of the surface of the body of fluid.

More preferably the fluid level changing apparatus as above described may further comprise at least a subsequent member having substantially similarly defined components, i.e., subsequent member input apertures, input reservoirs, connecting channels, output reservoirs and output apertures and into which the captured packet of fluid flows as a consequence of the cycles of the rocking motion.

Even more preferably there may be additional members all of which are positioned sequentially with respect to the subsequent member and with respect to other additional members. Each of the additional members have substantially similarly defined components, i.e., additional member input apertures, input reservoirs, connecting channels, output reservoirs and output apertures.

A most fundamental aspect of the present invention is to provide an apparatus or fluid ladder for use in elevating a fluid comprising: means for creating at least two reservoirs, preferably more than two but the number of which is a function of the elevation to be achieved but wherein each of the reservoirs are in sequential and serial fluid flow relationship each to the other; a means for providing unidirectional fluid flow communication of the fluid between the adjoining reservoirs; and a means for oscillatingly causing the fluid to incrementally and sequentially, as a predetermined volume packet of fluid, elevate from an input port of the fluid ladder to an exit port when the fluid ladder is in use.

A further most fundamental aspect of the present invention is to provide the apparatus as above described but having additionally a means for applying an energy source to affect the means for oscillatingly, at a controllable and selectable oscillation frequency, causing the fluid to incrementally and sequentially elevate. The energy source may be selected from the group consisting of; electrical, internal combustion, fluidic, thermal, pneumatic and muscle.

A yet further most fundamental aspect of the present invention is to provide the apparatus as above described but wherein the means for providing unidirectional fluid flow communication of the fluid between the reservoirs comprises one-way valves. The one-way valves prevent the fluid from flowing back into a fluid source.

A still yet further most fundamental aspect of the present invention is to provide the fluid ladder as above described further comprising a means for controlling the volume amount of each of the predetermined volume packets of fluid being incrementally and sequentially elevated and subsequently exited from the exit port. The means for controlling the volume amount of the predetermined volume packet of fluid is at least one means selected from the group consisting of; changing the size/geometry of each of the reservoirs, controlling the amplitude of rocking or oscillation controlling an inclination angle, the inclination angle being the angle formed by a vertical ray (vertical from the surface of the body of fluid being elevated) and the ray defined by the direction of the unidirectional fluid flow from the input port to the exit port of the fluid elevating ladder.

BRIEF DESCRIPTION OF THE SEVERAL VIEWS OF THE DRAWINGS

These and further objects of the present invention will become apparent to those skilled in the art after a study of the present disclosure of the invention and with reference to the accompanying drawing which is a part hereof, wherein like numerals refer to like parts throughout, and in which:

FIG. 1 is a transparent planar view of a schematic representation of the fluid ladder before fluid lifting has begun;

FIGS. 2A, 2B, 2C and 2D depict enlarged schematic planar views of reservoirs at opposing ends of upwardly-directed and downwardly-directed channels;

FIGS. 9A and 9B is a pictorial schematic top plan view and a cross-section end view of an apparatus of the type of the invention installed within a small boat for the purpose of automatic bailing of the boat as a consequence of random rocking of the boat caused by water movement.

DETAILED DESCRIPTION OF THE INVENTION

Figure 3:
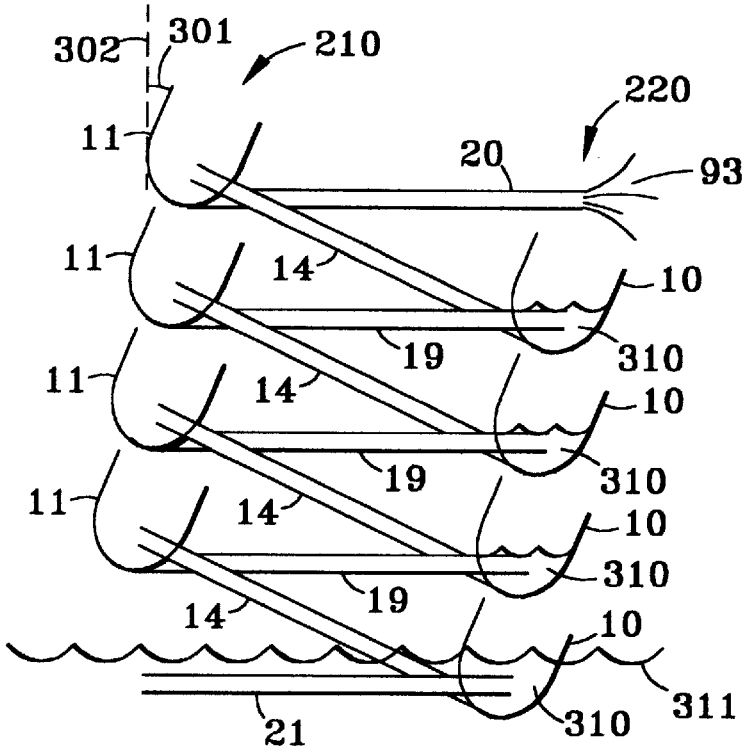
FIG. 3 is a transparent planar view of a schematic representation of the fluid ladder after fluid lifting has begun.

The use of fluid herein shall, unless otherwise stated, mean any form of material such as suggested above. Fluid is lifted to higher levels by the rocking motion of the apparatus such as the ladder-type apparatus, which apparatus will be frequently referred to simply as a ladder or the ladder. In the case of a fluid-like solid, simultaneous vibrating and rocking the ladder may provide an increase in flow volume, i.e., cause better flow. Fluid flows upwardly from the body of fluid from the lowest to the highest of the reservoirs through connecting channels connecting adjacent or subsequently more elevated reservoirs. It should be understood that the reservoirs are considered as subsequently elevated when the apparatus is positioned for use in the elevation of fluid. Fluid is prevented from flowing down the ladder by the design and geometry of the structure and of the connection between the channels and the reservoirs.

Common to all of the embodiments disclosed in detail, suggested, and generally discussed herein, is that the each type of apparatus functions according to the method of elevating fluid using a rocking motion or sometimes referred to as an oscillation or oscillatory motion. When the apparatus is rocked to lower an input aperture of a first member of the apparatus into the body of fluid and upon the commencing of rocking away from the body of fluid and the surface of the fluid, a packet or volume of fluid is captured in an input reservoir portion. As the rocking motion continues, the packet of fluid is caused to moved through a connecting channel toward an output reservoir which is located higher than the surface of the fluid when the rocking motion is at the end of the cycle. At this time and position in the rocking cycle, the captured packet of fluid exits through an output aperture and through an input aperture and into another or subsequent reservoir from which the packet of fluid will not flow back into the output reservoir of the first member. The input reservoir of this subsequent member (or additional member) then begins elevating due to the rocking motion now changing direction so that the input reservoir of the subsequent member begins to rise sending the packet of fluid through the connecting channel and toward the output reservoir and associated output aperture of the subsequent member. When the rocking motion reaches the maximum (or minimum depending upon perception) amplitude in the direction of lowering the input aperture of the first member into the body of fluid, another packet of fluid is captured and at the same time the initial captured packet of fluid is passing out of the subsequent member and either into an input aperture and reservoir of another or additional member, or the packet of fluid is otherwise deposited at an elevated location from the surface of the body of fluid.

Referring to FIG. 1, the preferred embodiment of fluid ladder 100 comprises open-topped, cup-like reservoirs 11 and 10 situated in columns 210 and 220 respectively, and channels 14, 19, 20, and 21. Reservoirs 11 are connected to reservoirs 10 through cylindrical hollow channels 14 and 19, either open or closed, with opposing ends 16 and 35 for channel 14, and 86 and 72 for channels 19.

Channel 21 provides fluid 92 intake to reservoir 25, the lowest of the reservoirs, at end 24. Likewise, channel 20 provides fluid 92 output through opposing end 93 that is fed by end 26, which is connected to reservoir 27, the highest of the reservoirs.

Channels 19, 20, and 21 are vertically upward-oriented at angle 30 from x-axis 40. Channels 14 are vertically downward-oriented at angle 32 from x-axis 40. The magnitude of angles 30 and 32, as well as the sizes of channels 14, 19, 20, and 21, affect the rate at which fluid flows, but not the presence or absence of fluid flow. There is a minimum angle below which nothing will happen and there is a maximum angle dictated by the geometry of the device which is not an angle defined by the principle of operation.

Referring now to FIGS. 2A and 2B, channels 14, comprising hollow cylinder 33 and ends 16 and 35, rigidly connect reservoirs 11 and 10 at ends 16 and 35 respectively. Reservoirs 11 are recessed to accept ends 16 of channels 14 such that angle 66 is formed between lower channel entry point 38 and x-axis 40. Also, channels 14 extend distance 64 at ends 16 into reservoirs 11. Ends 35 of channels 14 are rigidly connected to reservoirs 10, which are recessed to accept flush-mounted channels 14 at ends 35 at angles 39 formed between upper channel entry point 204 and x-axis 40.

Referring now to FIGS. 2C and 2D, channels 19, comprising hollow cylinder 34 and ends 86 and 72, rigidly connect reservoirs 11 and 10 at ends 86 and 72 respectively. Reservoirs 10 are recessed to accept ends 72 of channels 19 such that angle 68 is formed between lower channel entry point 202 and x-axis 40. At ends 72, channels 19 extend distance 76 into reservoirs 10. Ends 86 of channels 19 are rigidly connected to reservoirs 11, which are recessed to accept flush-mounted channels 19 at ends 86 at angles 67 formed between upper channel entry point 203 and x-axis 40.

Fluid ladder 100 must be constructed such that air cannot become trapped, such air working to exert pressure and prevent fluid 92 from flowing through ladder 100 to be discharged at end 93. Fluid 92 traveling through the reservoirs 10 and 11 and channels 14 and 19 must be subjected to atmospheric pressure so that when the volume of air in reservoirs 10 and 11 is reduced, reservoirs 10 and 11 don't experience an increase in pressure from the air onto the fluid, which in turn could cause the fluid currently in reservoirs 10 and 11 to rise to the level of connection points 16 and 72 and flow back down channels 14 and 19.

Fluid ladder 100 operates as follows. Each of channels 14 and 19 connects to the next higher reservoir in columns 210 and 220. Connection points 16 and 72 of channels 14 and 19 are above reservoir low points 68 and 80 respectively. Connection points 35 and 86 of reservoirs 10 and 11 respectively are at bottoms 230 and 231 of reservoirs 10 and 11, respectively. This pattern of connections is the same for the plurality of reservoirs 10 and 11, channels 14 and 19.

Referring now to FIG. 3, fluid ladder 100, is tilted in the direction of column 220 at angle 301 from y-axis 302. At angle 301, fluid 310 that had been in reservoirs 11 flows into reservoirs 10. At the same time, channel 21 becomes filled because it is immersed below fluid level 311. More specifically, reservoirs 11 fill reservoirs 10 through channels 19. Channels 19 are able to drain reservoirs 11 because they are connected at points 86 to bottom 231 of reservoirs 11. Channels 14 are not able to drain reservoirs 11 because ends 16 are above bottoms 68 of reservoirs 11. Thus, fluid 92 has flowed from reservoirs 11 to reservoirs 10, but only upwards to the next higher reservoir in fluid ladder 100.

Figure 4:
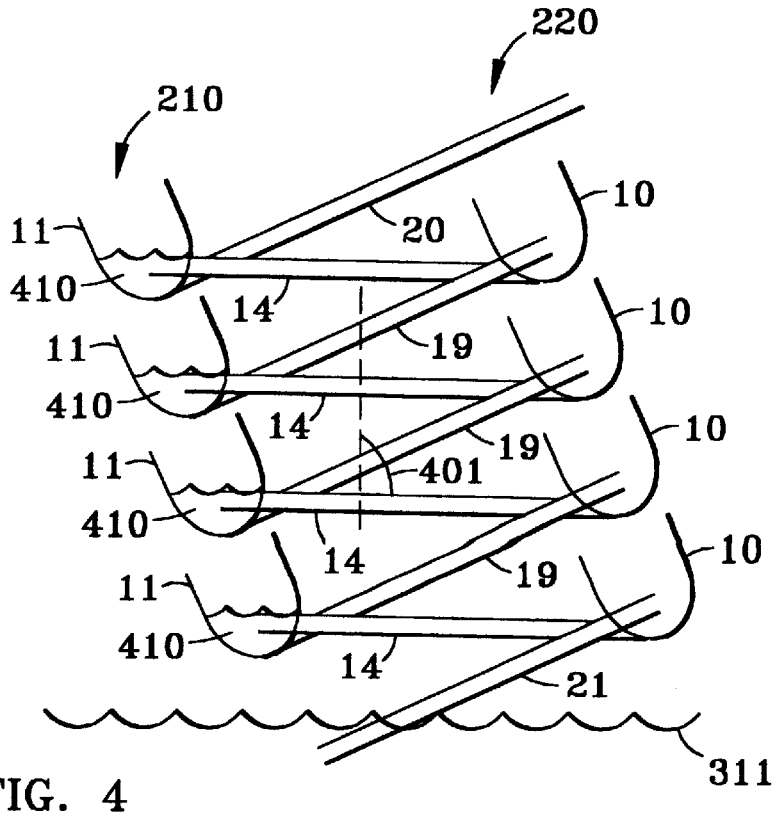
FIG. 4 is a transparent planar view of a schematic representation of the fluid ladder as fluid lifting continues.

Referring now to FIG. 4, fluid ladder 100, tilted in the direction of column 210 at angle 401 from y-axis 402, completes the lifting cycle. At angle 401, fluid 410 that had been in reservoirs 10 flows into reservoirs 11. More specifically, reservoirs 10 fill reservoirs 11 through channels 14. Channels 14 are able to drain reservoirs 10 because they are connected at points 35 to bottom 230 of reservoirs 10. Channels 19 are not able to drain reservoirs 10 because ends 72 are above bottoms 80 of reservoirs 10. Thus, fluid 92 has flowed from reservoirs 10 to reservoirs 11, but only upwards to the next higher reservoir in fluid ladder 100.

As ladder 100 rocks back and forth as shown in FIGS. 3 and 4, fluid 92 works it's way up to the next higher reservoir until it reaches exit channel 20. Fluid 92 leaves ladder 100 at exit point 93.

Figure 5:
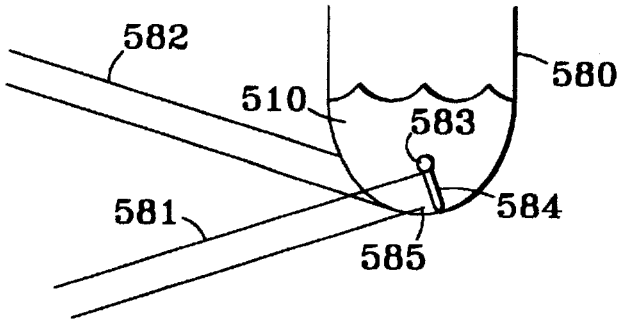
FIG. 5 is a transparent planar view of a schematic representation of an alternate fluid backflow prevention means.

In another embodiment, and referring to FIG. 5, channel 581 is not able to drain reservoir 580 because end 585 is covered with one-way valve 584. Valve 584 prevents fluid 510 from flowing down channel 581. Incoming channel 581 is covered with one-way flapper valve 584 at point 585 where channel 581 enters reservoir 580. Valve 584 swings on pivot point 583. If fluid 510 attempts to enter incoming channel 581, valve 584 will close. Outgoing channel 582 is the same as channels 14 in the previous embodiment.

Figure 6:
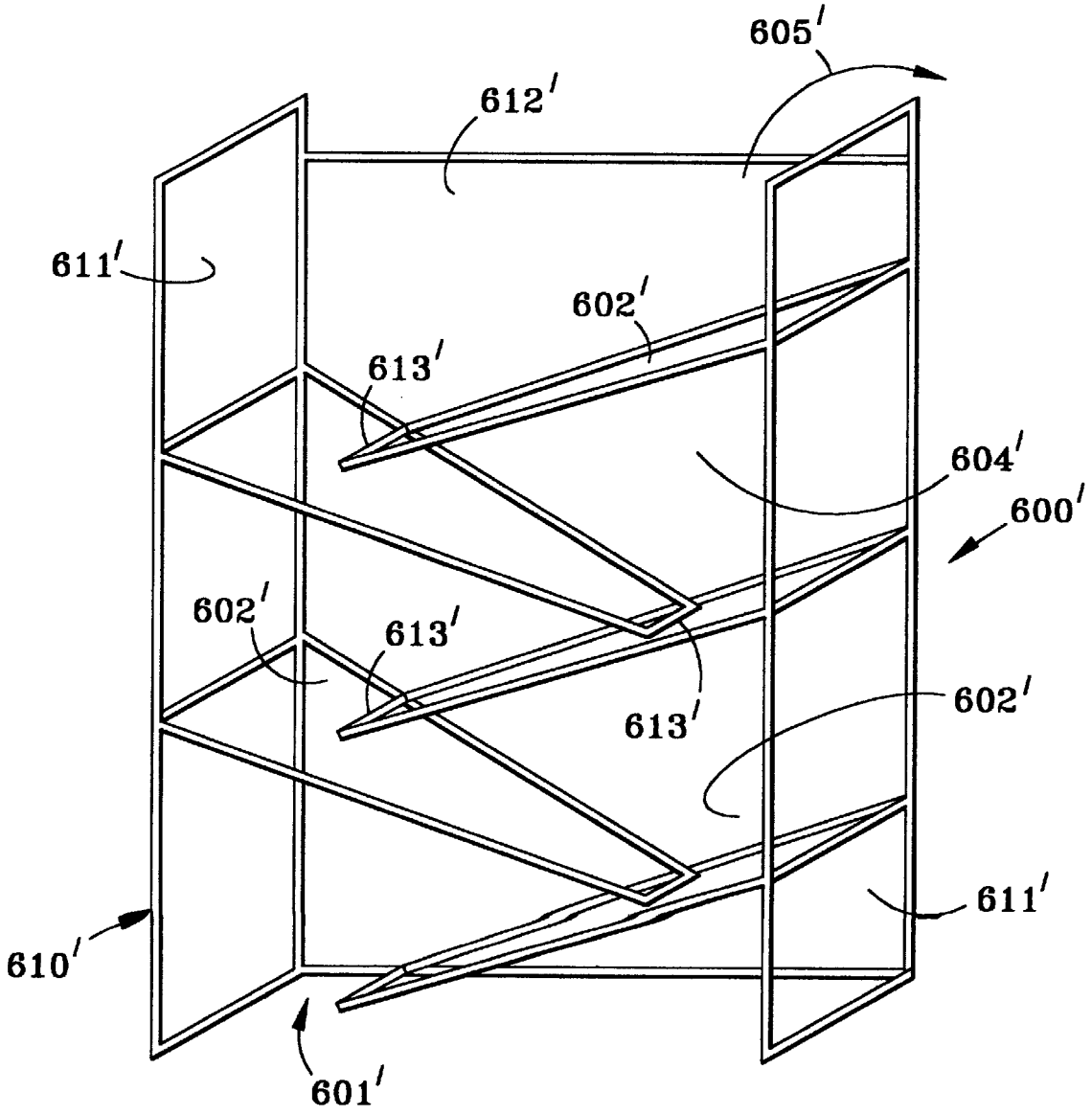
FIG. 6 is a perspective sketch of an embodiment wherein the components are transparent in order to disclose the relationship of the components.
Figure 7:
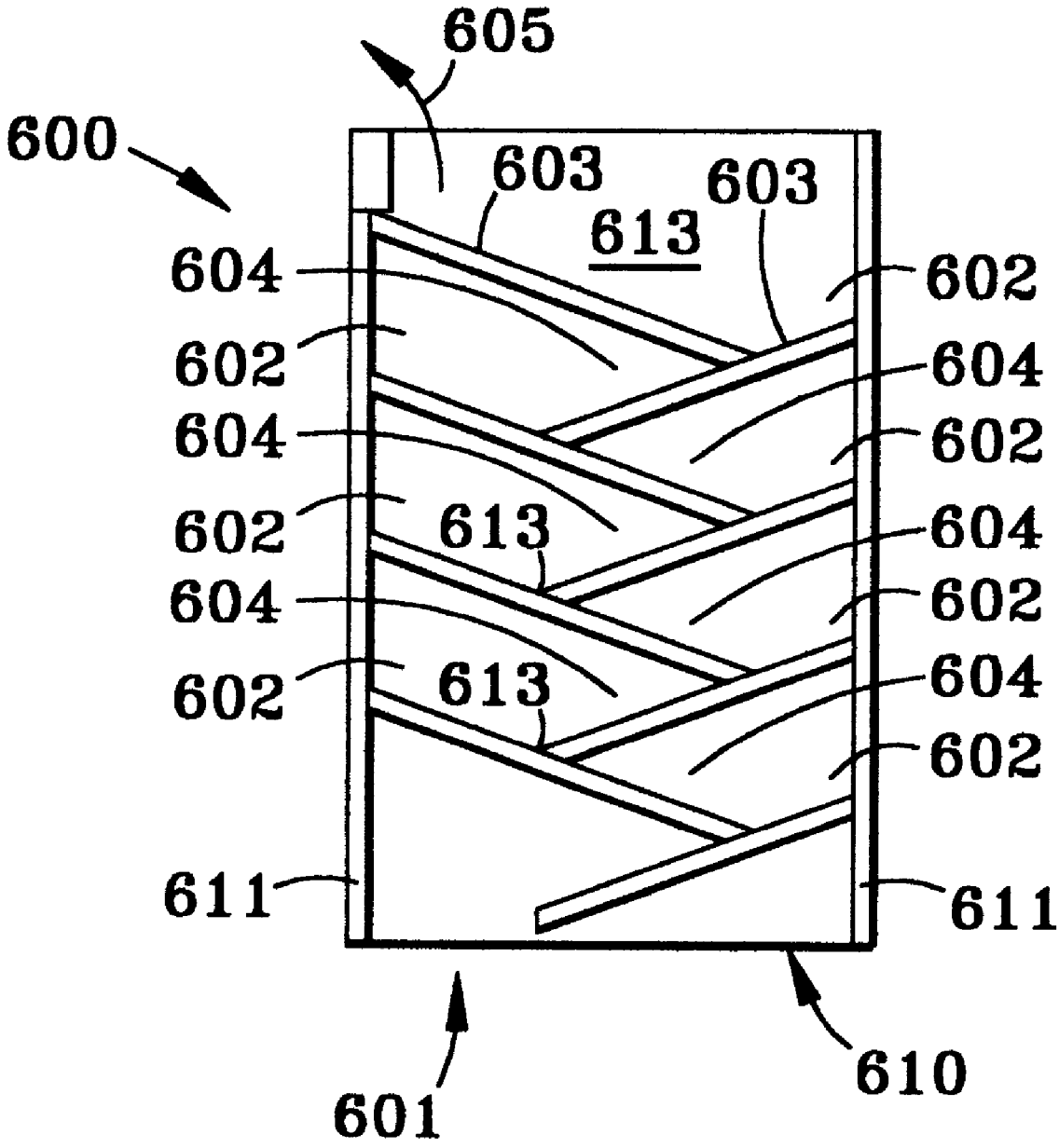
FIG. 7 is a top plan view of substantially the embodiment of FIG. 6 but which illustrates the variations in the numbers of channels and reservoirs and the intake and discharge locations.

Reference is now made to FIGS. 6 and 7 which is a perspective sketch of an embodiment 600' and a top plan view respectively of a similar embodiment but identified by numeral 600 because of the difference in the number of components, i.e., differences in the numbers of channels and reservoirs and the intake and discharge locations. The components are illustrated as transparent in order to disclose the relationship of the components. For the purpose of illustration, it could be assumed that ladder 600' is made of pieces of transparent Plexiglas which serves well to illustrate the manner of operation and which provides for a view of the progression of the fluid, such as water, from reservoir 602' to reservoir 602' through or by way of the adjoining and connecting channels 604'.

To carry out the analogy to a ladder fluid lifting device 600 or 600' has a plurality of ladder steps 603/603' which are attached to ladder legs 611/611' and a ladder back 612/612'. There is fluid input end or port 601/601' and a fluid output end or exit port 605/605'. The upward facing surfaces of steps 603/603' near legs 611/611' in combination with back 612/612' create reservoirs 602/602' for each of the steps up the ladder. When ladder 600 or 600' is in operation and input end 601 or 601' is placed into the body of fluid and oscillated, fluid passes into port 601, 601' then through channel 604, 604' over the step-to-step joint 613 or 613' and into the next reservoir 602 or 602'. On the next half cycle of oscillation, the fluid similarly moves to the next more elevated reservoir. The fluid progresses upwardly one reservoir on one side of the ladder for each cycle of oscillation until the fluid, in substantially measured amount, exits from exit port 605 or 605'.

While there are many additional embodiments of apparatus which will perform the function of the invention in substantially similar manner, in order to most clearly teach the fundamentals of the instant method and apparatus, such additional embodiments will not be discussed in great detail.

Figure 8A:
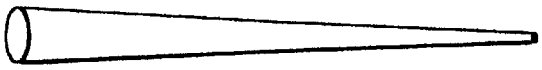
FIGS. 8A, 8B, 8C, 8D and 8E are a series of sketches which illustrate an alternative embodiment of the invention shown in various degrees of rocking of oscillation and which illustrate the changes in the distance between the fluid levels within the conical curved tube, with FIG. 8D illustrating a combination of conical curved tubes for elevating fluid.
Figure 8B:
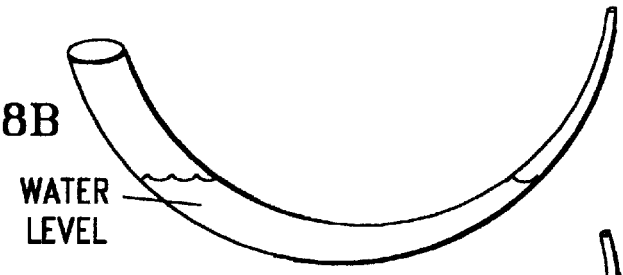
Figure 8C:
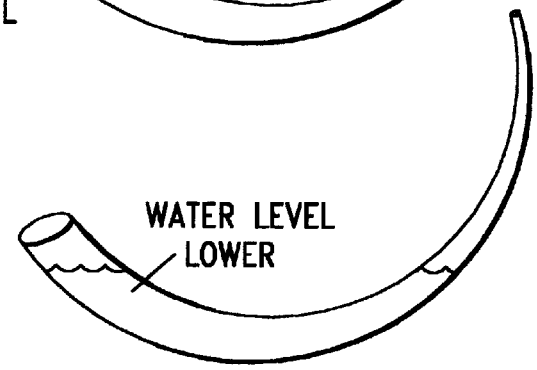
Figure 8D:
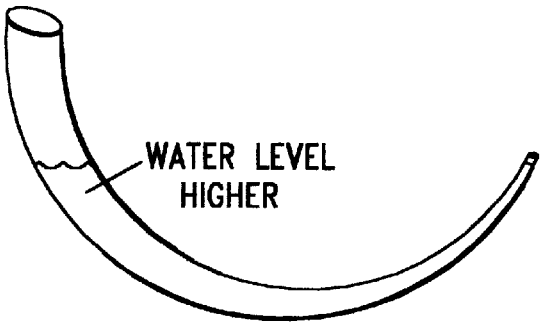
Figure 8E:
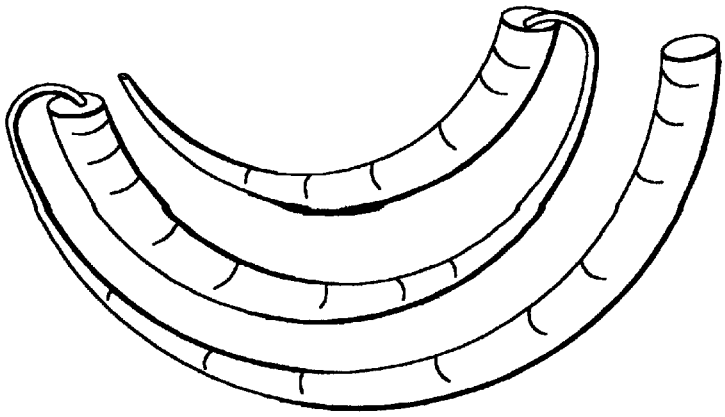

Reference is now made to FIGS. 8A, 8B, 8C, 8D and 8E which are a series of sketches which illustrate yet another alternative embodiment of the invention shown in various degrees of rocking of oscillation and which illustrate the changes in the distance between the fluid levels within the conical curved tube. FIG. 8D illustrates in very simple fashion, a combination of conical curved tubes for elevating fluid. The representations of FIGS. 8A, 8B, 8C, 8D and 8E are particularly illustrative of a conical pipe or tube which is curved upward at both the larger and smaller diameter ends. If the conical pipe is partially filled with fluid (i.e., a captured packet of fluid), when the conical pipe is rocked so as to lower the larger diameter end, the fluid will extend, from fluid surface location near the larger diameter end to the fluid surface location toward the smaller diameter end and within the pipe, a determinable distance. When the pipe is rocked so as to lower the smaller diameter end, the distance between the two fluid surface locations is increased. I.e., since the volume of packet of fluid has not changed but the average cross sectional area has decreased, the length of the packet of fluid must increase. Consequently the packet of fluid picked up or captured during the oscillation phase where the larger diameter end is lowered is elevated and may pour out of the opening at the smaller diameter end. If there is another conical pipe with the large diameter end located so as to capture the fluid coming from the first conical pipe, the captured fluid will be further elevated and will pour out of the smaller diameter end of the second conical pipe. It is clear that this process will result in the periodic discharge of fluid, the period being related to the frequency of the rocking or oscillatory motion of the apparatus.

FIGS. 9A and 9B is a pictorial schematic top plan view and a cross-section and transparent end view of an apparatus of the type of the invention installed within a small boat for the purpose of automatic bailing of the boat as a consequence of random rocking of the boat caused by water movement. The design of a ladder for a particular boat will differ according to the geometry of the boat. Each step of the ladder should advance an equal volume packet of fluid to the next level. If one step of the ladder advances too large a volume to the next level then the excess will flow backward down the ladder. The entire ladder will move only that volume of fluid that the step with the lowest volume moves. This above principle must be taken into account when a ladder is designed for a particular boat. The portion of the ladder whose reservoirs are near the center of the boat will experience less differential height change between the reserviors than the portion of the ladder that has it's reservoirs away from the center of the boat. Thus, the portion of the ladder that is near the center of the boat will need larger reservoirs and a smaller step to be able to pump the specified fluid packet volume.

Another embodiment not illustrated herein, called a tube ladder, consists of an interconnection of tubing—plastic, metal or otherwise which provides similarly functioning reservoirs and channels interconnecting the reservoirs. The tubing assembly is placed into the body of fluid, oscillated from side-to-side. In time following a number of oscillation cycles, which number of cycles depends upon the geometry of the tubing assembly and the height to which the fluid is elevated, fluid will be discharged in measurable packets or amounts. The amount incremented from the output end of the tube ladder is consistent and is a function of the size of the tubing and the geometry of the structure.

It should also be noted that it is possible to cause the elevation of fluid by motion which is not necessarily a rocking motion, rocking motion being angular around a substantially fixed axis. There could be motion which may be characterized as a "sloshing" motion, i.e., a to-and-fro motion but not around a fixed axis. Fluid would be picked up as a result of motion in a first direction and it could "slosh" to an elevated reservoir. Movement then in a direction substantially opposite the direction of the first direction would cause the portion of the captured fluid which got from the pick-up reservoir to the first elevated reservoir to then be "sloshed" to another further elevated reservoir, and so on. At least a portion of the packet of fluid would be caused to "slosh" from a lower reservoir portion to an elevated reservoir and finally exit the apparatus at an elevated location.

The preferred embodiment was described to provide the best illustration of the principles of the invention, but not to limit modifications allowed under this description and claims. The preferred embodiment is meant to enable one of ordinary skill in the art to use the invention with various modifications. All such modifications and variations are within the scope of the invention as determined by the appended claims.

I claim:

1. A fluid ladder for use in elevating a fluid comprising:

means for creating at least two reservoirs, wherein each of said at least two reservoirs are in sequential and serial fluid flow relationship each to the other;

means for providing unidirectional fluid flow communication of said fluid between said at least two reservoirs; and means for oscillatingly causing said fluid to incrementally and sequentially, as a predetermined volume packet of fluid, elevate from an input port of said fluid ladder to an exit port when said fluid ladder is in use.

2. The fluid ladder according to claim 1 further comprising:

means for applying an energy source to affect said means for oscillatingly causing said fluid to incrementally and sequentially elevate, said energy source being selected from the group consisting of; electrical, internal combustion, fluidic, thermal, pneumatic and muscle.

3. The fluid ladder according to claim 1 wherein said means for providing unidirectional fluid flow communication of said fluid between said at least two reservoirs comprises one-way valves said one-way valves preventing said fluid from flowing back into a fluid source.

4. The fluid ladder according to claim 2 wherein said means for providing unidirectional fluid flow communication of said fluid between said at least two reservoirs comprises one-way valves said one-way valves preventing said fluid from flowing back into a fluid source.

5. The fluid ladder according to claim 1 further comprising:

means for controlling the volume amount of each said predetermined volume packet of fluid being incrementally and sequentially elevated and subsequently exited from said exit port.

6. The fluid ladder according to claim 2 further comprising:

means for controlling the volume amount of each said predetermined volume packet of fluid being incrementally and sequentially elevated and subsequently exited from said exit port.

7. The fluid ladder according to claim 3 further comprising:

means for controlling the volume amount of each said predetermined volume packet of fluid being incrementally and sequentially elevated and subsequently exited from said exit port.

8. The fluid ladder according to claim 4 further comprising:

means for controlling the volume amount of each said predetermined volume packet of fluid being incrementally and sequentially elevated and subsequently exited from said exit port.

9. The fluid ladder according to claim 5 wherein said means for controlling the volume amount of each said predetermined volume packet of fluid is at least one means selected from the group consisting of; changing the size of each said at least two reservoirs, controlling an inclination angle, said inclination angle being the angle formed by a vertical ray and the ray defined by the direction of said unidirectional fluid flow from said input port to said exit port and the amplitude of said means for oscillatingly causing.

10. The fluid ladder according to claim 6 wherein said means for controlling the volume amount of each said predetermined volume packet of fluid is at least one means selected from the group consisting of; changing the size of each said at least two reservoirs, controlling an inclination angle, said inclination angle being the angle formed by a vertical ray and the ray defined by the direction of said unidirectional fluid flow from said input port to said exit port and the amplitude of said means for oscillatingly causing.

11. The fluid ladder according to claim 2 wherein said means for applying an energy source to affect said means for oscillatingly causing is at a controllable and selectable oscillation frequency.

12. The fluid ladder according to claim 6 wherein said means for applying an energy source to affect said means for oscillatingly causing is at a controllable and selectable oscillation frequency.

13. An apparatus for changing the level of a captured packet of fluid, said packet of fluid have a predetermined volume, as a consequence of a rocking motion relative to the surface of a body of fluid from which said captured packet of fluid is to be taken, said fluid level changing apparatus comprising:

a first member comprising, a first member input aperture positionable at said surface of said fluid for capturing said captured packet of fluid, a first member input reservoir portion into which said captured packet of fluid enters, a first member connecting channel portion contiguous and in flow communication with said first member input reservoir portion, a first member output reservoir portion in substantially unidirectional flow communication with said first member connecting channel portion, wherein said unidirectional flow is from said first member input reservoir portion to said first member output reservoir portion, a first member output aperture from which said packet of fluid exits at a level above the level of said surface of said body of fluid.

14. The fluid level changing apparatus according to claim 13 further comprising a subsequent member, said subsequent member comprising; a subsequent member input aperture in flow communication with said first member output aperture of said first member, a subsequent member input reservoir portion into which said captured packet of fluid enters through said subsequent member input aperture from said output aperture of said first member, a subsequent member connecting channel portion contiguous and in flow communication with said subsequent member input reservoir portion, a subsequent member output reservoir portion in substantially unidirectional flow communication with said subsequent member connecting channel portion, wherein said substantially unidirectional flow is from said first member input reservoir portion to said first member output reservoir portion, and a subsequent member output aperture from which said packet of fluid exits at a level above the level of said surface of said body of fluid.

15. The fluid level changing apparatus according to claim 14 further comprising at least one additional member, each said at least one additional member in sequential flow communication each with the other and with said first member, each of said at least one additional member comprising; an additional member input aperture in flow communication with said first member output aperture, an additional member input reservoir portion into which said captured packet of fluid enters through said additional member input aperture from said output aperture of said first member, an additional member connecting channel portion contiguous and in flow communication with said additional member input reservoir portion, an additional member output reservoir portion in substantially unidirectional flow communication with said additional member connecting channel portion, wherein said substantially unidirectional flow is from said additional member input reservoir portion to said additional member output reservoir portion, an additional member output aperture from which said packet of fluid exits into another of said at least one additional member at a level above the level of said surface of said body of fluid.

16. A method for changing the level of a captured packet of fluid as a consequence of a rocking motion, said method comprising the steps of:

rocking, causing capturing, into an input reservoir, of a packet of fluid from a body of said fluid, said body of fluid having a surface thereof;

subsequent rocking, causing said captured packet of fluid to directionally flow through connecting channels from said input reservoir to another subsequent elevated reservoir;

continued rocking for a number of cycles needed to caused said captured packet of fluid to be sequentially elevated and to exit from an output reservoir at an elevation higher than said body of fluid surface.

* * * * *